US006625393B2

(12) United States Patent
Eller et al.

(10) Patent No.: US 6,625,393 B2
(45) Date of Patent: Sep. 23, 2003

(54) WATER PREHEATING CONNECTION PIECE

(75) Inventors: Martin Eller, Ludwigsburg (DE); Martin Allgaier, Ludwigsburg (DE)

(73) Assignee: Beru AG, Ludwigsburg (DE)

( * ) Notice: Subject to any disclaimer, the term of this patent is extended or adjusted under 35 U.S.C. 154(b) by 0 days.

(21) Appl. No.: 10/223,376

(22) Filed: Aug. 20, 2002

(65) Prior Publication Data

US 2003/0039474 A1 Feb. 27, 2003

(30) Foreign Application Priority Data

Aug. 22, 2001 (DE) ..... 101 40 183

(51) Int. Cl.[7] ..... H05B 3/78
(52) U.S. Cl. ..... 392/489; 219/220
(58) Field of Search ..... 219/270, 260, 219/267; 392/200, 202, 489

(56) References Cited

U.S. PATENT DOCUMENTS 5,084,607 A * 1/1992 Shafer et al. ..... 219/270

FOREIGN PATENT DOCUMENTS

EP 903541 A2 * 3/1999 ..... F23Q/7/00

OTHER PUBLICATIONS

Loctite—Technical Data Sheet, Product 648. Oct. 1995.*
Loctite—Retaining, pp 50–51.*

* cited by examiner

*Primary Examiner*—Thor Campbell
(74) *Attorney, Agent, or Firm*—Nixon Peabody LLP; David S. Safran

(57) ABSTRACT

A water preheating connection piece (6) including a connection body including a water flow channel (6*a*) and a bore hole (7), at least one heating rod (1) having an internal heating element and at least one regulating element for insertion into the bore of the connection body, the at least one heating rod projecting into the water flow channel (6*a*), the heating rod (1) including a connection pole (3) that extends from the heating rod (1) whereby the connection pole is electrically insulated from the heating rod (1). The heating rod (1) does not include external threads and the bore hole of the connection body does not include internal threads so as to permit the heating rod (1) to be press-fit therein.

10 Claims, 4 Drawing Sheets

WATER PREHEATING CONNECTION PIECE

BACKGROUND OF THE INVENTION

1. Field of the Invention

The invention relates to a water preheating connection piece with at least one heating rod that has an internal heating element and a heating rod which is adapted for connection to the water preheating connection piece.

2. Description of the Related Art

Water preheating connection pieces are known in which glow plugs having a glow plug body with external threads and a hexagonal nut for screwing-in are screwed into a drill-hole of a preheating connection piece, the drill-hole being provided with an internal thread that cooperate with the external threads of the glow plug body.

For instance, FIGS. 4(*a*) and (*b*) show a conventional water preheating connection piece 9 with fitted glow plugs 8 with a glow plug body, having an external thread and a hexagonal nut 10 for screwing into drill-holes of the connection piece 9 with corresponding internal threads. Such a design, however, is disadvantageous in that the overall weight is large, and thus, it becomes susceptible to breakage due to vibrations in the case of its use in motor vehicles and also increases the likelihood of improper sealing at the threads.

SUMMARY OF THE INVENTION

An object of the present invention is to provide a water preheating connection piece and a heating rod for the water preheating connection piece which can be economically manufactured. The water preheating connection piece and a heating rod in accordance with the present invention is lightweight and provides a more rigid connection while, at the same time, reducing the risk of breakage due to vibration.

The problems associated with conventional water preheating connection pieces are solved in accordance with the present invention by providing a water preheating connection piece with at least one heating rod having an internal heating element, and optionally, at least one regulating element, the heating rod projecting into a water through-flow channel. The heating rod is designed without an external thread, and thus, is press-fit into a threadless drill-hole of the water preheating connection piece. A connection pole projects from the heating rod and is electrically insulated against the casing of the heating rod.

Instead of being press-fit into the drill-hole of the water preheating connection piece, an adhesive such as glue may be used to connect the heating rod to the drill-hole such that a sealing edge that encircles the heating rod is preferably formed on the heating rod. The drill-hole of the water preheating connection piece is also provided with a circumferential sealing edge.

DETAILED DESCRIPTION OF THE INVENTION

Figure 4A:
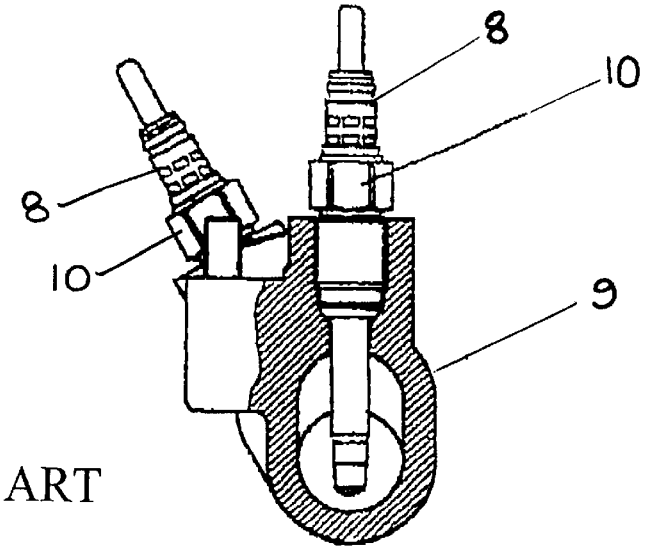
PRIOR ART FIG. 4(a)
FIGS. 4(*a*) & 4(*b*) show, in partial cross-section and a partial longitudinal section, a known water preheating connection piece.
Figure 4B:
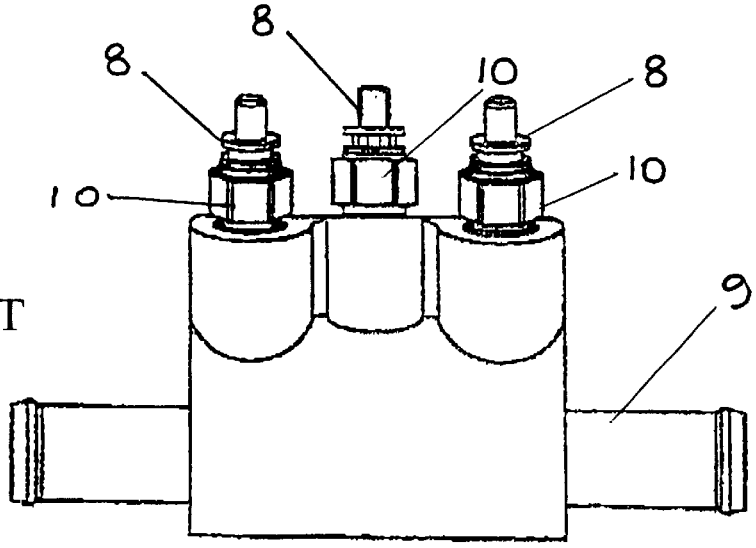
PRIOR ART FIG. 4(b)

In the following, the same reference numerals as used above with respect to the known connection piece of FIGS. 4(*a*) & 4(*b*) are used to identify corresponding parts of the connection piece of the present invention to facilitate comparison therebetween.

Figure 1:
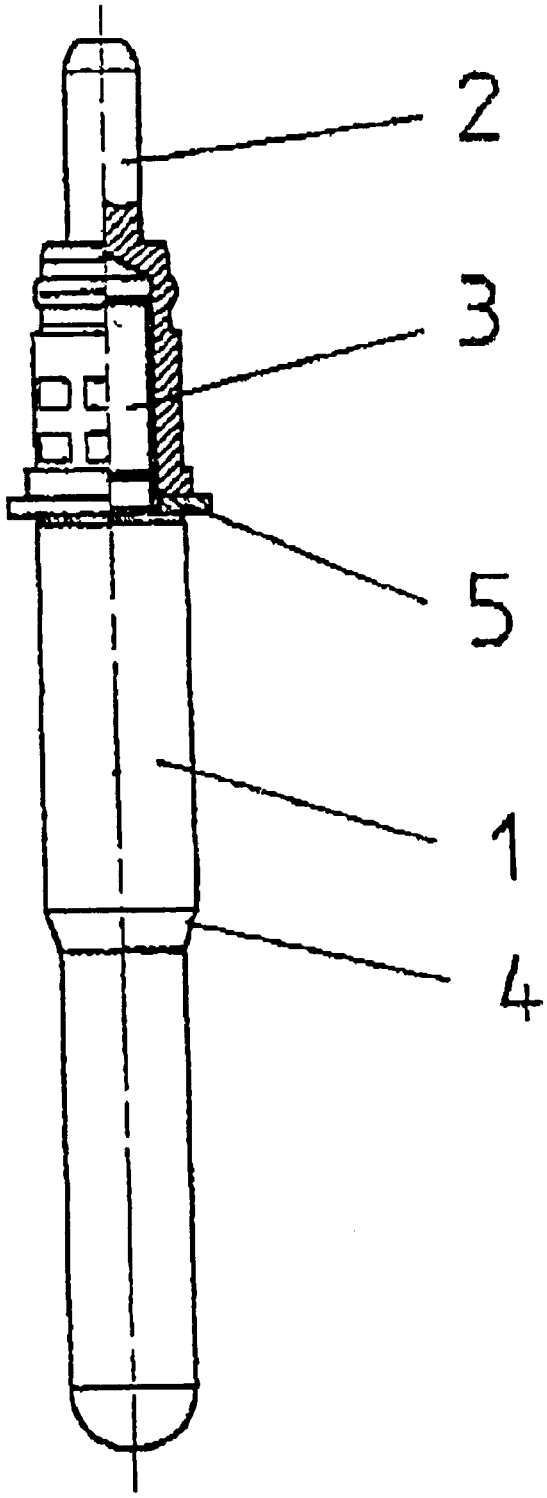
FIG. 1 shows a partial longitudinal section of a heating rod in accordance with the present invention.

FIG. 1 shows a heating rod 1 in accordance with the present invention that includes a metallic tubular casing that is closed at a bottom end thereof, in which heating elements, and optionally, regulating elements (not shown) composed of MgO are embedded therein. Shown opposite from the bottom end, i.e., the connection side, the heating and/or regulating elements are connected to a connection pole 3, which in turn is connected to a electrical connection 2, whereby the electrical connection 2 can be designed as a circular connector or a screw connector. The connection pole 3 is provided with a thread or knurl in order that a circular connector, a thread, or a cable sleeve can, be fitted. Alternatively, the electrical connection element 2 can be to be crimped to connection pole 3. The connection pole 3 is electrically insulated against the casing of the heating rod 1 by way of an insulating disc 5.

Figure 2A:
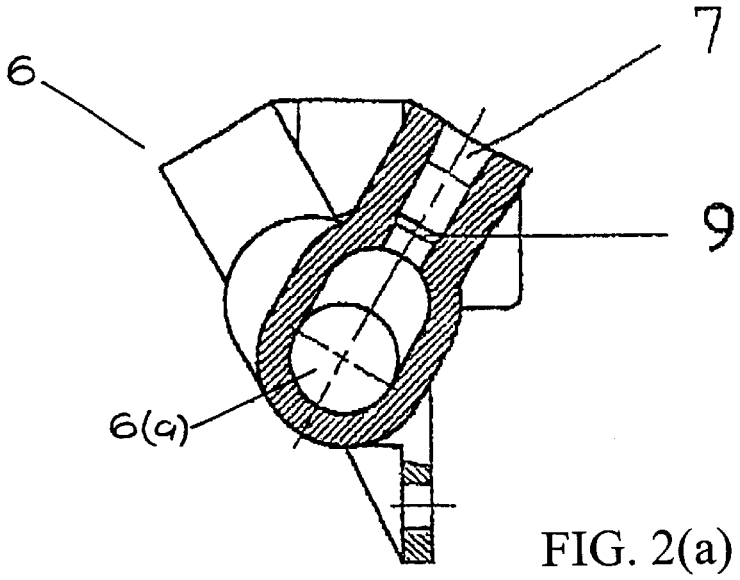
FIGS. 2(*a*) & 2(*b*) show, in a partial cross-section and a partial longitudinal section, a water preheating connection piece without inserted heating rods in accordance with the present invention.
Figure 2B:
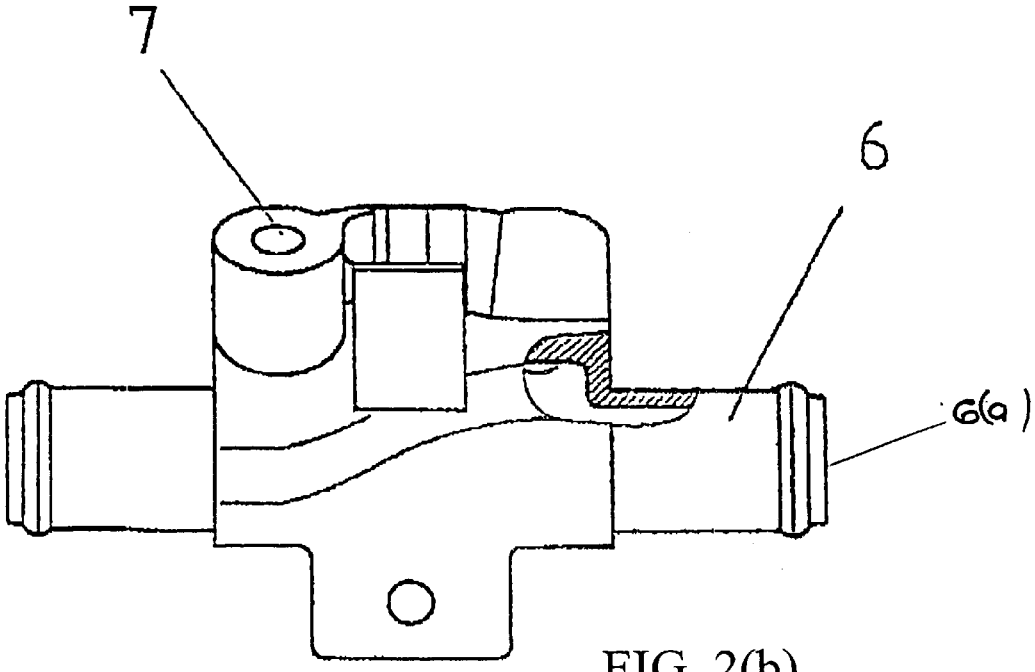

As shown in FIGS. 1 and 2(*a*) & 2(*b*), in order to form a watertight seal, the heating rod 1 includes a sealing edge 4 that extends circumferentially and which seals the heating rod 1 once it is inserted into the drill or bore hole 7 of a water preheating connection piece 6, which includes a cooperating circumferential sealing edge 9 that extends around the bore hole 7. Unlike prior art heating rods, the heating rod 1, in accordance with the present invention, does not have a glow plug body with an external thread or an external thread for screwing into the drill-hole 7 of the water preheating connection piece 6.

FIGS. 2(*a*) & 2(*b*) show the water preheating connection piece 6 without fitted heating rods, the water preheating connection piece 6 including a connection piece body having a flow channel 6(*a*) in which water flows therethrough. The heating rod 1 is fixedly connected or inserted into the drill-hole 7. Unlike prior art water preheating connection pieces, no internal threads are provided in the drill-holes 7.

Figure 3A:
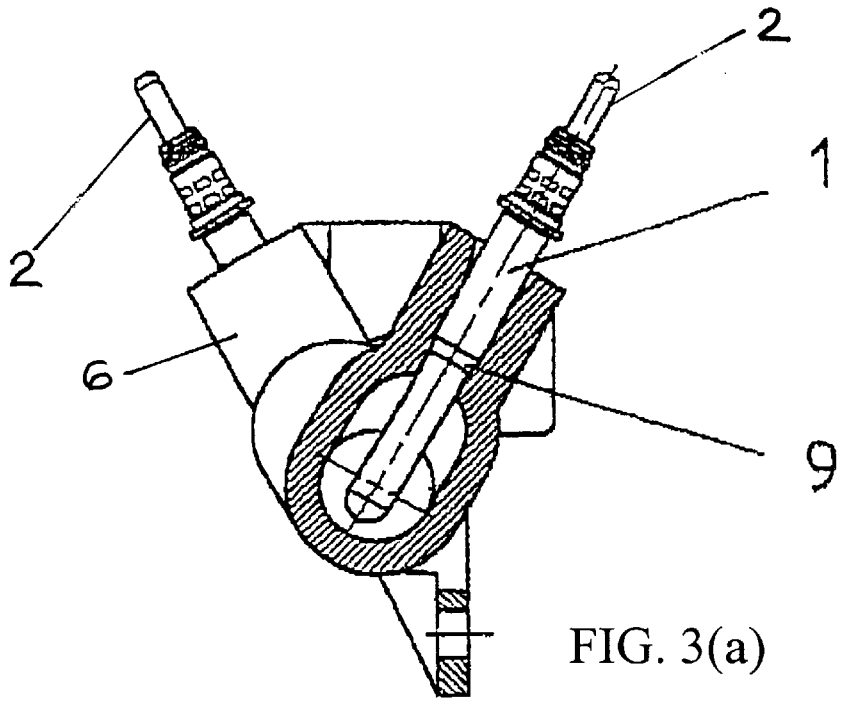
FIGS. 3(*a*) & 3(*b*) show the water preheating connection piece of FIGS. 2(*a*) & 2(*b*) with inserted heating rods in accordance with the present invention.
Figure 3B:
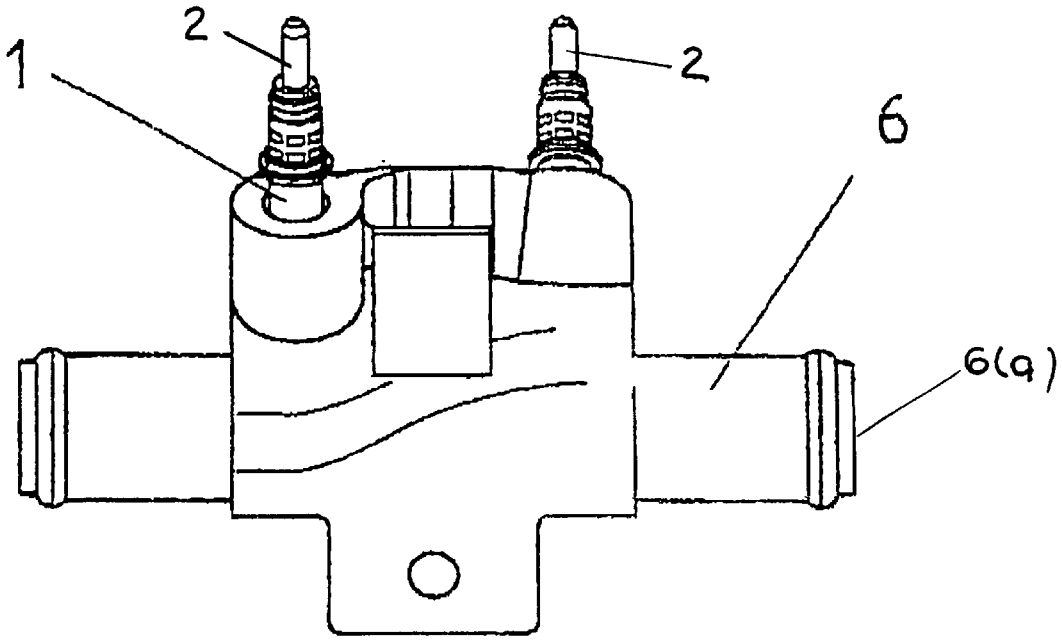

FIGS. 3(*a*) & 3(*b*) show the water preheating connection piece 6 of FIGS. 2(*a*) & 2(*b*) fitted with heating rods 1 in accordance with the present invention. While the heating rods 1 are shown press-fit into drill-holes 7, a sealing adhesive compound, such as glue or epoxy, may be used. In this regard, LOCTITE® 648 is a sealing adhesive compound that may be used.

As shown in FIG. 1, because the water preheating connection piece 6 of the present invention is provided with an additional seal obtained by way of the sealing edge 4, increased pressure requirements can be obtained. Furthermore, as a result of the absence of a glow plug body and the need for a hexagonal nut, narrower design spaces, for example, the distance between heating elements, are made possible. As a result of the absence of internal or external threads, shorter heating elements can also be provided so that the overall size and weight of the water preheating connection piece 6 can be reduced. It is also particularly advantageous that the vibration loads on the connection piece 6 are smaller with a shorter construction. In the pre-assembly, moreover, heating rods 1 can be fitted that have differing heating behavior and differing power, for example, 150, 300 and 600 Watts, in order to achieve increased power.

What is claimed is:

1. A water preheating connection piece comprising:

a connection body including a water flow channel and a bore hole;

at least one heating rock comprised of a heating element within a tubular casing, said at least one heating rod being inserted into the bore hole of the connection body, the at least one heating rod projecting into the water flow channel and a connection pole that extends from the heating rod, the connection pole being electrically insulated from the casing of the heating rod, wherein the at least one heating rod is seated in the connection body by a threadless connection between the casing of the heating rod and the bore hole of the connection body, the casing of the heating rod being directly press-fit in the bore hole.

2. The water preheating connection piece according to claim 1, wherein the casing of the heating rod includes a circumferential sealing edge that cooperates with a circumferential sealing edge of the bore hole of the water preheating connection piece to provide a watertight seal.

3. The water preheating connection piece according to claim 2, wherein the heating rod is secured in the bore hole with a sealing adhesive compound.

4. The water preheating connection piece according to claim 2, wherein the circumferential sealing edge of heating rod is located at a lengthwise intermediate portion of the casing of the heating rod.

5. The water preheating connection piece according to claim 1, wherein the heating rod is secured in the bore hole with a sealing adhesive compound.

6. A heating rod for insertion into a bore hole of a water preheating connection piece, the heating rod comprising:

a heating element within a tubular casing, said casing having a circumferential sealing edge for engaging, in use, with a circumferential sealing edge of the bore hole of the water preheating connection piece to provide a watertight seal; and a connection pole that extends from the heating rod on a connection end thereof, wherein the casing of the heating rod is adapted for direct connection in the bore hole of the water preheating connection piece in a threadless, press-fit manner.

7. The rod-shaped heating rod according to claim 6, further comprising an electrical connector that is connected to the connection pole by one of a threaded connection, a circular connection and a crimped connection.

8. The rod-shaped heating rod according to claim 6, wherein the circumferential sealing edge of the heating rod is located at a lengthwise intermediate portion of the casing of heating rod.

9. The rod-shaped heating rod according to claim 6, wherein the connection pole is insulated from the casing of the heating rod by an electrical insulator disposed between an upper end of the casing and the connection pole.

10. The water preheating connection piece according to claim 1, wherein the connection pole is electrical insulated from the casing of the heating rod by an insulator disposed between an upper end of the casing and the connection pole.

* * * * *